US005108321A

United States Patent [19]

Nelson

[11] Patent Number: 5,108,321

[45] Date of Patent: Apr. 28, 1992

[54] MOTOR BOAT WITH AUXILIARY MOTOR

[75] Inventor: Charles D. Nelson, Little Falls, Minn.

[73] Assignee: Crestliner, Inc., Little Falls, Minn.

[21] Appl. No.: 536,508

[22] Filed: Jun. 12, 1990

[51] Int. Cl.[5] ..... B63H 21/26

[52] U.S. Cl. ..... 440/3; 114/56; 114/57; 114/343; 114/355; 440/53

[58] Field of Search ..... 440/3, 6, 7, 53, 54, 440/60, 61, 62, 63, 900; 114/56, 57, 355, 343

[56] References Cited

U.S. PATENT DOCUMENTS

| | | | |
|---|---|---|---|
| 2,895,445 | 7/1959 | Foraker | 440/63 |
| 3,057,320 | 10/1962 | Daniels | 440/62 |
| 3,274,849 | 9/1966 | Hanson | 440/900 |
| 3,294,054 | 12/1966 | Norton | 440/60 |
| 4,304,556 | 12/1981 | Wilson | 440/63 |
| 4,668,197 | 5/1987 | Proto | 440/3 |
| 4,776,818 | 10/1988 | Cahoon et al. | 440/53 |
| 4,784,074 | 11/1988 | Michalak | 114/57 |

FOREIGN PATENT DOCUMENTS

| | | | |
|---|---|---|---|
| 2036389 | 1/1972 | Fed. Rep. of Germany | 114/343 |
| 2509688 | 1/1983 | France | 440/53 |

*Primary Examiner*—Sherman D. Basinger
*Assistant Examiner*—Thomas J. Brahan
*Attorney, Agent, or Firm*—Barnes, Kisselle, Raisch, Choate, Whittemore & Hulbert

[57] ABSTRACT

A motor boat with auxiliary and main motors and having a transom with a pocket or recess constructed and arranged to receive and support an auxiliary outboard motor. The auxiliary motor is connected to a steering control in a helm control center which steers both the auxiliary and main motors. Preferably operating controls enable starting, tilting and steering of both motors and associated propulsion assemblies from the helm. Preferably, the operating controls include a cable carried in a sheathing attached to a steering wheel mounted in the helm control center and adapted to turn or move the rudder of the main motor and the auxiliary motor propulsion assembly to thereby steer the boat.

7 Claims, 2 Drawing Sheets

MOTOR BOAT WITH AUXILIARY MOTOR

FIELD OF INVENTION

This invention relates to motor boats and more particularly to the mounting of an auxiliary motor on a boat.

BACKGROUND OF THE INVENTION

Motor boats utilizing powerful inboard or outboard engines generally lack the capability to slowly move or troll through waters. This inability to travel at a slow, steady speed causes great difficulties in navigating the boat into a dock space. Also, these powerful motor boats are not ideal for fishing because the boat travels at a speed that causes too great a disturbance through the water and drags bait through the water too fast. Additionally, for all single engine motor boats there is the distinct possibility of being stranded out on the water far from shore without another mechanical mode of propulsion. Generally, these motor boats are not designed to be manually rowed or paddled to shore.

Some motor boats have a low horsepower auxiliary motor mounted to the transom to provide slow trolling speeds not attainable by the main motor and as an emergency backup to the main motor. Generally, the auxiliary motor is secured to the side of the transom or on the rear deck of the boat. The engine portion of the auxiliary motor extends above the deck and has a long shaft downwardly extending into the water and generally below the hull of the boat. When the auxiliary motor is not in use, this shaft impedes the steering of the boat by causing an off-center drag on the boat and thereby pulling the boat in one direction. To prevent this, the auxiliary motor must be tilted into the passenger area, reducing the seating area of the boat. When the auxiliary motor is utilized, it must be steered from the rear of the boat by manually gripping and moving an extension arm attached to the auxiliary motor. The boat operator's view from this position is limited and generally obstructed by the front portion of the boat and by other passengers. This causes a potentially serious safety hazard.

SUMMARY OF THE INVENTION

In accordance with the invention there is provided a motor boat with provision for a main motor and an auxiliary motor and having a transom with a pocket or recess constructed and arranged to receive and support an auxiliary outboard motor mounted thereon, the auxiliary motor is connected to operating controls located at a helm control center which operate both the auxiliary and main motors. These operating controls enable steering and preferably also starting and tilting of the auxiliary motor from the helm. Preferably, the operating controls include a steering wheel mounted in the helm control center and adapted to turn or move the respective propulsion drive and rudder assemblies of main and auxiliary motors to thereby steer the boat.

Objects, features and advantages of this invention are to provide a motor boat accommodating an auxiliary outboard motor that is easy to control and use from a remote helm control center; a common steering control for both main and auxiliary motors; and controls which enable steering, and starting and tilting of an auxiliary motor from a main control center that are of relatively simple and economical design, manufacture and assembly.

BRIEF DESCRIPTION OF THE DRAWINGS

These and other objects, features and advantages of this invention will be apparent from the following detailed description, appended claims and accompanying drawings in which:

DETAILED DESCRIPTION

Figure 1:
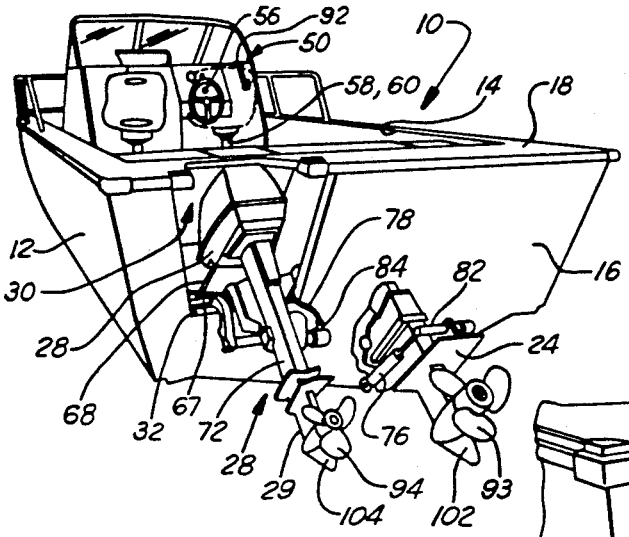
FIG. 1 is a perspective view of a boat embodying this invention.
Figure 5:
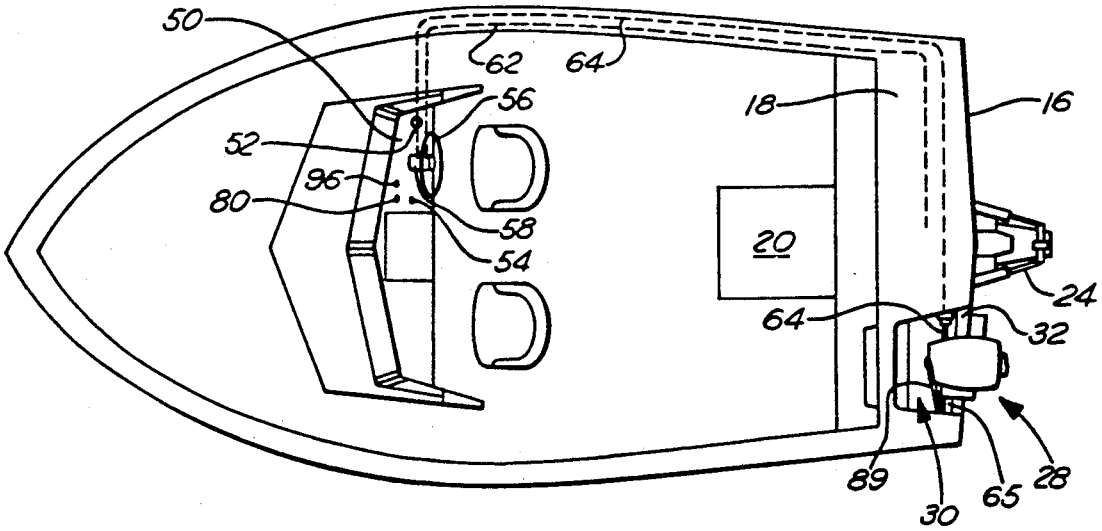
FIG. 5 is a plan view of the boat of FIG. 1.

FIGS. 1-5 illustrate a preferred embodiment of a motor boat 10 embodying this invention. As shown in FIGS. 1 and 5, the motor boat 10 has opposed side walls 12, 14, a transom 16 therebetween forming the rear portion of the boat 10, and a rear deck 18 overlapping the top of transom 16 and a portion of the side walls 12, 14. To move and steer the boat 10, a main motor 20 is provided with a stern propulsion drive and rudder assembly 24. If, as shown, the assembly 24 extends through the lower central portion of the transom 16, the arrangement of the motor and assembly is commonly referred to as an inboard/outboard drive. (see FIG. 1).

Figure 2:
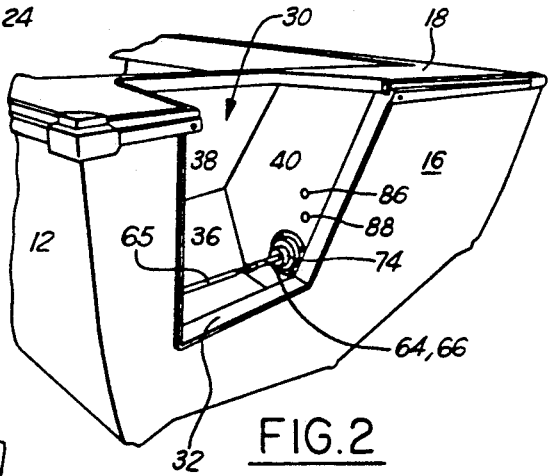
FIG. 2 is an enlarged fragmentary perspective view of the boat of FIG. 1.
Figure 3:
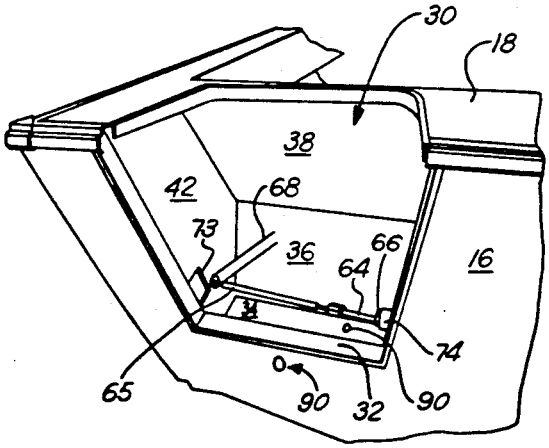
FIG. 3 is an enlarged fragmentary perspective view of a pocket transom of the boat of FIG. 1.
Figure 4:
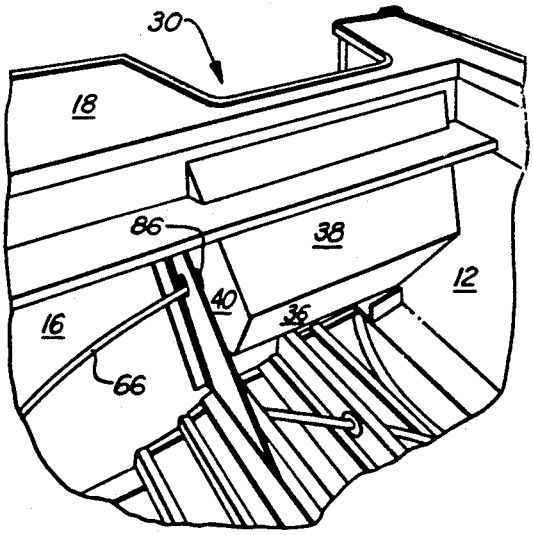
FIG. 4 is an enlarged fragmentary perspective view of the pocket transom from inside the boat of FIG. 1.

In the event motor 20 and/or propulsion assembly 24 are inoperable, as shown in FIGS. 2 and 3, an auxiliary outboard motor 28, with a propulsion drive and rudder assembly 29 is provided to move and steer the boat 10. Motor 28 and assembly 29 are conveniently received and supported in a pocket or recess 30 formed in the transom 16 and rear deck 18 of the boat 10. So that the auxiliary motor 28 does not obstruct the rear view or detract from the appearance of the boat 10 (see FIG. 1), a rear edge lip 32 of pocket 30 is integral to and positioned on the transom 16 to support the low horsepower auxiliary outboard motor 28 mounted thereon below the rear deck 18.

Preferably, pocket 30 occupies as little space as possible in the stern of boat 10 and preferably it is constructed of several suitably dimensioned sections and has a bottom panel 34 below lip 32 which extends inward from the transom 16 and adjoins an inclined panel 36 that is contiguous with the lower edge of a front panel 38 that extends to the rear deck 18. A pair of spaced apart side panels 40, 42 are connected to the bottom panel 34, inclined panel 36 and front panel 38.

A helm control center or console 50 is located distal from the stern and preferably in the forward portion of the boat 10 and positioned so that a driver's view in all directions is unobstructed, while operating the boat. This console 50 typically includes a main motor starter or ignition control 52, a main motor tilt control 54, and a steering wheel 56 carried by a column 58 (see FIG. 5).

In order to steer boat 10, wheel 56 is turned so as to move both the assembly 24 of main motor 20 and assembly 29 of auxiliary motor 28. More specifically, the rotating motion of wheel 56 is translated into linear axial motion by coupling means 60 which is connected to first and second control cables 62, 64. Cable 62 is connected to the propulsion drive and rudder assembly 24 to move it to steer the boat 10 when powered by the main motor 20. As wheel 56 is turned, coupling means 60 translates rotary movement of the wheel 56 to linear axial movement of the first cable 62 which moves assembly 24 of main motor 20.

In order to steer while using motor 28, wheel 56 is turned and coupling means 60 translates this turning motion into axial linear motion of cable 64. Cable 64 is coupled to outboard motor 28 by a rod 65 and an arm 68. As shown in FIGS. 3 and 5, arm 68 is pivotally connected at one end to the rod 65 and at the other end to motor 28 at the forward or helm side of the motor 28. Thus, rod 65 moves arm 68 which rotates motor 28. The rotating motion of motor 28 is transferred to the propulsion drive and rudder assembly 29 of motor 28, through housing 72 thereby steering the boat 10. Therefore, as wheel 56 is turned, coupling means 60 transfers motion to second cable 64 which moves axially through sheath 66 to move rod 65 which then moves arm 68 to turn motor 28 and the propulsion drive and rudder assembly 29 connected thereto through housing 72. Preferably, an opening 73 in panel 42 provides a clearance hole for the rod 65 and arm 68 when rod 65 is fully extended. Preferably, each cable 62, 64 is slidably received in a sheathing 66 attached to adjacent side wall 14 and the transom 16.

Preferably, main motor 20 and auxiliary motor 28 have respective tilt mechanisms 76, 78 actuated from the control console 50 through toggle switches 54, 80. Tilt mechanisms 76, 78 each include respective hydraulic drives 82, 84.

In normal operation, the boat 10 is moved and steered by main motor 20 and assembly 24, thus, the assembly 29 of auxiliary motor 28 is in the raised position. In this raised position, the motor 28 is accommodated by the opening in the rear deck 18 and pocket 30. The pocket 30 conveniently also has boots 86, 88 preferably in side wall 40 for ignition control cables and fuel delivery lines to the auxiliary motor 28. Preferably, a drain 90 for drainage of the pocket is provided in transom 16.

In the general procedure for normal operation, an operator at the helm control console 50 of the motor boat 10 engages control 54 to tilt the assembly 24 of the main motor 20 down into the water and below the hull of the motor boat. The operator then engages a throttle lever 92 to increase or decrease the boat propulsion drive 93 and uses steering wheel 56 to control the direction of the boat 10.

When a slower speed is desired or when the main motor 20 is inoperable, the boat operator engages a control 80 to tilt the auxiliary motor 28, housing 72 and assembly 29 to a lowered position wherein the propulsion drive or the propeller 94 of assembly 29 extends below the hull of the motor boat and preferably also engages control 54 to tilt the main motor's assembly 24 to a raised position.

The auxiliary motor 28 is then started from the control console 50 by ignition switch 96 and engaged to propel the boat 10 through the water at a slow speed such as the desired speed for trolling. To maneuver the boat 10, the steering wheel 56 may be rotated to the left or to the right as is done for steering of the main motor 20. Left and right as used herein refer to the operator's left and right as the operator faces forward. If the steering wheel 56 is turned to the right, the coupling means 60 moves cable 64 through sheathing 66, thereby moving rod 65, arm 68 and the forward side of motor 28 to the left; as the forward side of motor 28 moves to the left, assembly 29 is rotated about the axis of housing 72 to the right, causing boat 10 to turn to the right. Therefore, to steer boat 10 to the right, the wheel 56 is rotated clockwise as a result, motor 28 and assembly 29 are rotated counterclockwise on the axis of housing 72 causing the boat to turn right.

In this preferred embodiment, all tilting, steering and starting controls for the auxiliary motor 28 are at the control command console 50 of the boat 10. This allows the operator to more safely and conveniently operate the boat from its forward section.

It will be apparent that the invention may be used with any boat which requires a back-up means of propulsion and steering. The invention provides such back-up means operable from a single helm control console. Thus, it will be apparent the invention may be used with a boat having a single drive, that is, a single propeller and also with a dual drive, that is, two propellers, often called "twin screws". Conventional single and dual drives generally have inboard motors and drives, and outboard rudders which are separate from the motors and drives. The typical dual drive propulsion drive and rudder assembly includes two inboard propulsion drives and two outboard rudders which are separate from the drives. In this case, when the wheel is turned, the rudders are turned, and the propulsion drives are not turned.

A conventional inboard/outboard main motor usually has a propulsion drive and rudder assembly 24 comprising a propulsion drive or propeller 93 and a main rudder 102 as one unit. Conventional auxiliary motors have a propulsion drive and rudder assembly 29 comprising a propulsion drive 94 and a rudder 104 in a single unit, connected to motor 28 by housing 72.

In motor boats having a motor, shaft and drive assembly similar to the motor 28, housing 72 and assembly 29 of the invention, it is possible to turn the wheel and move the motor 28 while the motor 28 is tilted up.

I claim:

1. A motor boat comprising: a hull with a transom, a main motor in said hull, a stern drive propeller and rudder assembly outside of said hull with said propeller operably connected to said main motor and said propeller and rudder assembly being pivotally movable relative to said transom to steer the boat when driven by said main motor, a pocket having a front all, spaced apart side walls, and a rear opening through said transom laterally offset from the longitudinal centerline of said hull with a lower edge above the waterline of said hull and below the upper edge of said transom, and said pocket being constructed and arranged to receive only one auxiliary outboard motor therein, an auxiliary outboard motor having a propeller and rudder assembly and being removably mounted in said pocket and pivotally movable relative to said transom to steer the boat when driven by the auxiliary outboard motor, said auxiliary outboard motor having a lower horsepower maximum output relative to the maximum horsepower output of said main motor, a control console in said hull and distal from said transom of the boat, a steering wheel carried by said console, first and second control cables each operably coupled to said steering wheel, said first control cable operably coupled to said main propeller and rudder assembly and said second control cable operably coupled to said propeller and rudder assembly of said auxiliary outboard motor, and said first and second cables being respectively moved by turning said wheel to thereby move said respective main and auxiliary propeller and rudder assemblies relative to said transom when said steering wheel is turned to thereby steer said boat when it is driven by either said main motor or said auxiliary outboard motor.

2. A boat according to claim 1 which also comprises tilt mechanisms having a first hydraulic cylinder operably connected to said main motor propeller and rudder assembly and a second hydraulic cylinder operably connected to said auxiliary outboard motor propeller and rudder assembly, controls mounted on said control console which actuate said first hydraulic cylinder to move each of said main motor propeller and rudder assembly and said second hydraulic cylinder to move said auxiliary outboard motor propeller and rudder assembly from a lowered position to a raised position and from a raised position to a lowered position.

3. A boat according to claim 2 means which also comprises an ignition control for said auxiliary outboard motor and said ignition control is carried by said console.

4. A boat according to claim 1 which also comprises coupling means disposed between said wheel and said cables to translate rotary motion of the wheel to linear motion of the first and second cables.

5. A boat according to claim 1 wherein aid main motor is an inboard motor mounted adjacent the longitudinal centerline of said hull and said main motor stern drive propeller and rudder assembly is disposed adjacent a center portion of said transom.

6. A boat according to claim 1 wherein said pocket comprises rear, bottom, side and front panels housing the auxiliary motor and at least one opening in said pocket through which said second control cable passes.

7. A boat according to claim 1 wherein said transom has a rear deck lid adjacent the upper part thereof and said pocket has bottom, side and front panels constructed and arranged to provide sufficient clearance in said transom to accommodate said auxiliary motor below said rear deck lid and a rear edge lip adjacent said transom is constructed and arranged to support the auxiliary outboard motor mountable thereon below said rear deck lid.

* * * * *